US009376166B2

(12) United States Patent
Raiter et al.

(10) Patent No.: US 9,376,166 B2
(45) Date of Patent: Jun. 28, 2016

(54) HIGH EFFICIENCY SPONSONS FOR PONTOON BOAT

(71) Applicant: Larson Boats, LLC, Little Falls, MN (US)

(72) Inventors: Leon C. Raiter, Sartell, MN (US); Ronald Sahr, Cushing, MN (US)

(73) Assignee: Larson Boats, LLC, Hopkins, MN (US)

( * ) Notice: Subject to any disclaimer, the term of this patent is extended or adjusted under 35 U.S.C. 154(b) by 2 days.

(21) Appl. No.: 14/317,078

(22) Filed: Jun. 27, 2014

(65) Prior Publication Data

US 2015/0210357 A1 Jul. 30, 2015

Related U.S. Application Data

(60) Provisional application No. 61/932,442, filed on Jan. 28, 2014.

(51) Int. Cl.

| | |
|---|---|
| ***B63B 1/20*** | (2006.01) |
| ***B63B 1/12*** | (2006.01) |
| *B63B 1/18* | (2006.01) |

(52) U.S. Cl.

CPC . *B63B 1/20* (2013.01); *B63B 1/121* (2013.01); *B63B 1/125* (2013.01); *B63B 2001/186* (2013.01); *B63B 2001/201* (2013.01); *B63B 2001/206* (2013.01); *B63B 2001/208* (2013.01)

(58) Field of Classification Search

CPC ..... B63B 1/20; B63B 3/00

See application file for complete search history.

(56) References Cited

U.S. PATENT DOCUMENTS

| | | | | | |
|---|---|---|---|---|---|
| 3,168,425 | A * | 2/1965 | Wiplinger | B64C 35/00 | 114/291 |
| 5,184,561 | A * | 2/1993 | Nickell, Jr. | B63B 1/18 | 114/292 |
| 5,435,260 | A * | 7/1995 | Granie | B63B 1/12 | 114/290 |
| 5,522,333 | A * | 6/1996 | Lang | B63B 1/107 | 114/274 |
| 5,619,944 | A * | 4/1997 | Baker | G63G 1/042 | 114/283 |
| 5,676,087 | A * | 10/1997 | Baker | B63B 1/20 | 114/283 |
| 6,425,341 | B1 * | 7/2002 | Devin | B63B 1/042 | 114/288 |
| 6,708,642 | B1 * | 3/2004 | Taylor | B63B 1/042 | 114/290 |
| 7,827,926 | B2 * | 11/2010 | Payne | B63B 1/042 | 114/283 |
| 2008/0216729 | A1 * | 9/2008 | Chauveau | B63B 1/20 | 114/39.25 |
| 2009/0293790 | A1 * | 12/2009 | Bogard | B63B 1/20 | 114/61.2 |
| 2011/0265705 | A1 * | 11/2011 | Spade et al. | B63B 1/20 | 114/65 R |
| 2015/0210357 | A1 * | 7/2015 | Raiter | B63B 1/20 | 114/292 |

* cited by examiner

*Primary Examiner* — Lars A Olson
*Assistant Examiner* — Jovon Hayes
(74) *Attorney, Agent, or Firm* — Merchant & Gould P.C.

(57) ABSTRACT

The present disclosure relates to a sponson for a pontoon boat. The sponson has integrated chines and integrated splash guards. The sponson also includes a keel and deadrise surfaces on opposite sides of the keel. The sponson further includes an integrated keel reinforcement stringer within the sponson.

22 Claims, 12 Drawing Sheets

HIGH EFFICIENCY SPONSONS FOR PONTOON BOAT

CROSS-REFERENCE TO RELATED APPLICATION

This application claims the benefit of U.S. Provisional Application Ser. No. 61/932,442, filed on Jan. 28, 2014, which is incorporated herein by reference in its entirety.

TECHNICAL FIELD

The present disclosure relates generally to boats such as pontoon boats. More particularly, the present disclosure relates to pontoon boats having sponsons with planing or semi-planing capabilities.

BACKGROUND

A typical pontoon boat includes a deck mounted on at least two separate hulls. The separate hulls of a pontoon boat are commonly referred to as "tubes", "floats," "pontoons," "logs," or "sponsons." Commonly, pontoon boat sponsons function as displacement hulls and have generally cylindrical, tube-like shapes. A displacement hull is a hull that is supported exclusively or predominantly by buoyancy. Displacement hulls typically "plow" through the water and do not provide high levels of performance or efficiency.

In contrast to displacement hulls, planing hulls are hulls configured to develop positive dynamic pressure that creates lift causing hull draft to decrease with increasing speed. As a planning hull is lifted by dynamic pressure, the wetted surface area of the hull is reduced which reduces hull drag. As compared to displacement hulls, planing hulls are known to be more efficient at higher speeds and are known to provide higher performance particularly during turning. U.S. Pat. Nos. 5,184,561; 5,435,260; 5,522,333; and United States Patent Application Publication No. US2009/0293790 disclose pontoon sponsons that function as planing hulls. However, improvements are needed in his area.

SUMMARY

One aspect of the present disclosure relates to a pontoon sponson that provides enhanced performance (e.g., efficiency) and planing or semi-planing capabilities as compared to displacement-type sponsons. In certain embodiments, as compared to displacement-type sponsons, sponsons in accordance with the present disclosure can provide enhanced fuel economy and also allow for the use of engines with reduced horsepower. In certain embodiments, as compared to displacement-type sponsons, sponsons in accordance with the present disclosure can provide enhanced performance with regard to turning and maneuverability.

Another aspect of the present disclosure relates to a pontoon sponson having integrated longitudinal reinforcement. In certain embodiments, the longitudinal reinforcement can be provided by an integral stringer that extends inside the sponson along a keel of the sponson. Still further embodiments include hull stringers that extend parallel to the keel of the sponson.

A further aspect of the present disclosure relates to a pontoon sponson having enhanced lateral reinforcement. In certain embodiments, the sponson can include four or more separate bulkheads that provide lateral reinforcement to the sponson.

A further aspect of the present disclosure relates to a sponson having a bulkhead with an integrated ventilation tube. In certain embodiments, the ventilation tube is configured to equalized pressure within the sponson and to assure air entrapment within the sponson if the sponson is accidentally punctured. By entrapping air within the sponson, the sponson is prevented from filling with water thereby allowing for a safe return to shore.

A further aspect of the present disclosure relates to a pontoon sponson having dead rise surfaces on opposite sides of a keel and turned-down chines. In certain embodiments, the dead rise surfaces can have dead rise angles greater than 12 degrees and the chines can be turned down at an angle of 3-5 degrees. In further embodiments, a chamfer is provided between the dead rise surface and the chine.

Still another aspect of the present disclosure relates to a pontoon sponson having integrated inboard and outboard splash guards that extend along the length of the sponson. In certain embodiments, the splash guards assist in reinforcing the sponson as well as limiting splashing. In still other embodiments, the sponson can include integrated splash guards, integrated chines, and dead rise surfaces having dead rise angles greater than 12 degrees. Still another embodiment relates to a pontoon sponson having integrated chines, dead rise surfaces having dead rise angles greater than 12 degrees, and an integrated stringer that extends along the keel of the sponson. In certain embodiments, the integrated stringer can be formed by upturned flanges that are welded together and that are integral/unitary with inboard and outboard sidewalls of the sponson.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

DETAILED DESCRIPTION

As used herein, the term "reinforcing stringer" means a structure that provides reinforcement to a hull (e.g., a sponson) along an orientation that is parallel to or generally parallel to a length of the hull. In hull embodiments having a keel, the stinger extends parallel to or generally parallel to the keel. As used herein, the term "bulkhead" means a structure that provides reinforcement to a hull (e.g., a sponson) along an orientation that is parallel to or generally parallel to a width of the hull. In hull embodiments having a keel, bulkheads are parallel to or generally parallel to the keel. As used herein, the term "longitudinal" means an orientation that extends along the length of a hull. As used herein, the term "lateral" means an orientation that extends along a width of the hull.

Figure 1:
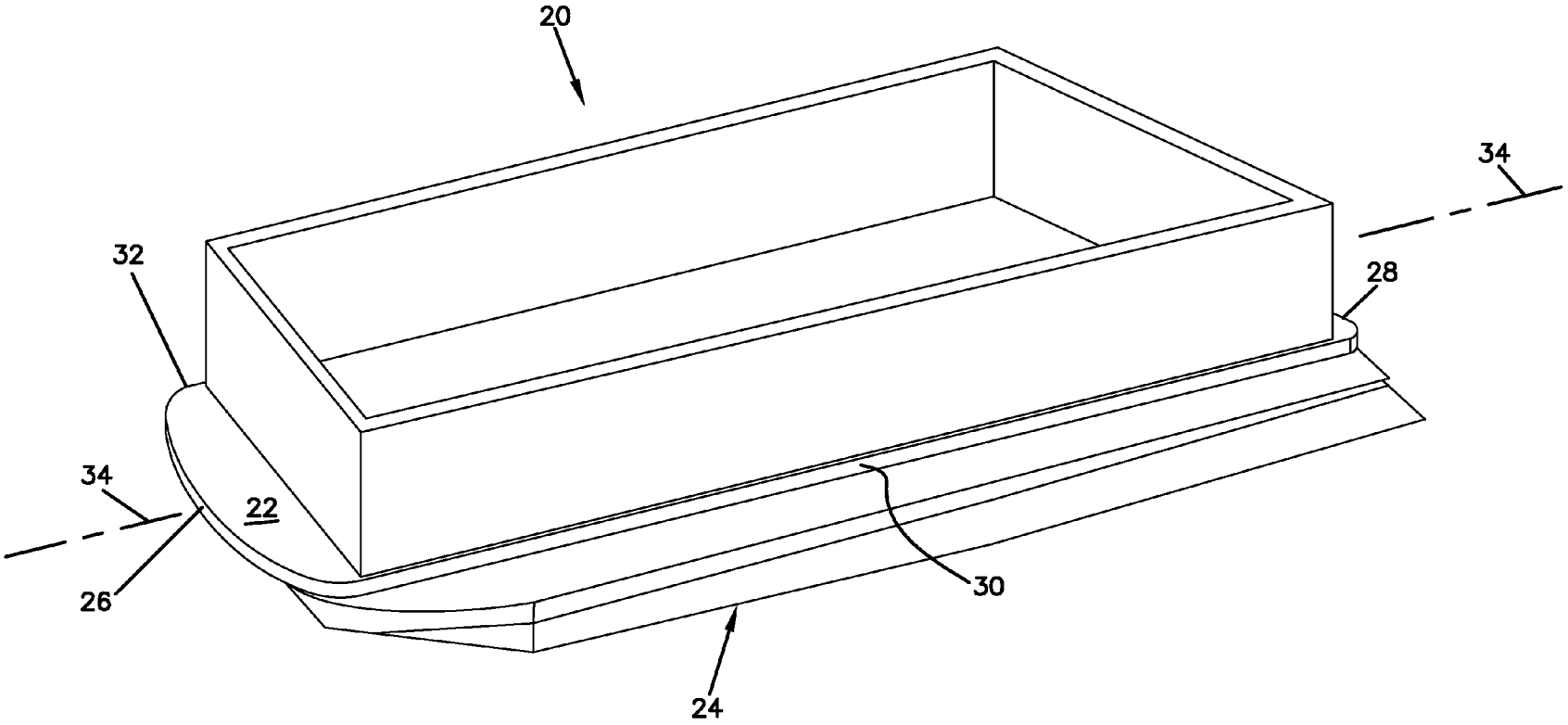
FIG. 1 is a perspective view of a pontoon boat in accordance with the principles of the present disclosure.

FIG. 1 illustrates a pontoon boat 20 in accordance with the principles of the present disclosure. The pontoon boat 20 includes a deck 22 supported on a plurality of sponsons 24 configured in accordance with the principles of the present disclosure. In the embodiment illustrated in FIG. 1, the deck 22 is supported on only two of the sponsons 24. However, in other embodiments, more than two of the sponsons 24 may be used.

Referring still to FIG. 1, the pontoon boat 20 includes a bow 26 positioned opposite from a stern 28. The pontoon boat 22 also includes a port side 30 positioned opposite from a starboard side 32. A longitudinal axis 34 is shown bisecting the pontoon boat 20 along its length. As used herein, the terms "inboard" and "outboard" are relative terms described in relation to the longitudinal axis 34. For example, with respect to a sponson, an inboard side of the sponson the side that is closer to the longitudinal axis 34 and an outboard side of the sponson is the side of the sponson that is farther away from the longitudinal axis 34. Similarly, with respect to a sponson, an inboard chine of the sponson is the chine that is closer to the longitudinal axis 34 and the outboard chine is the chine of the sponson that is farther away from the longitudinal axis 34.

Figure 18:
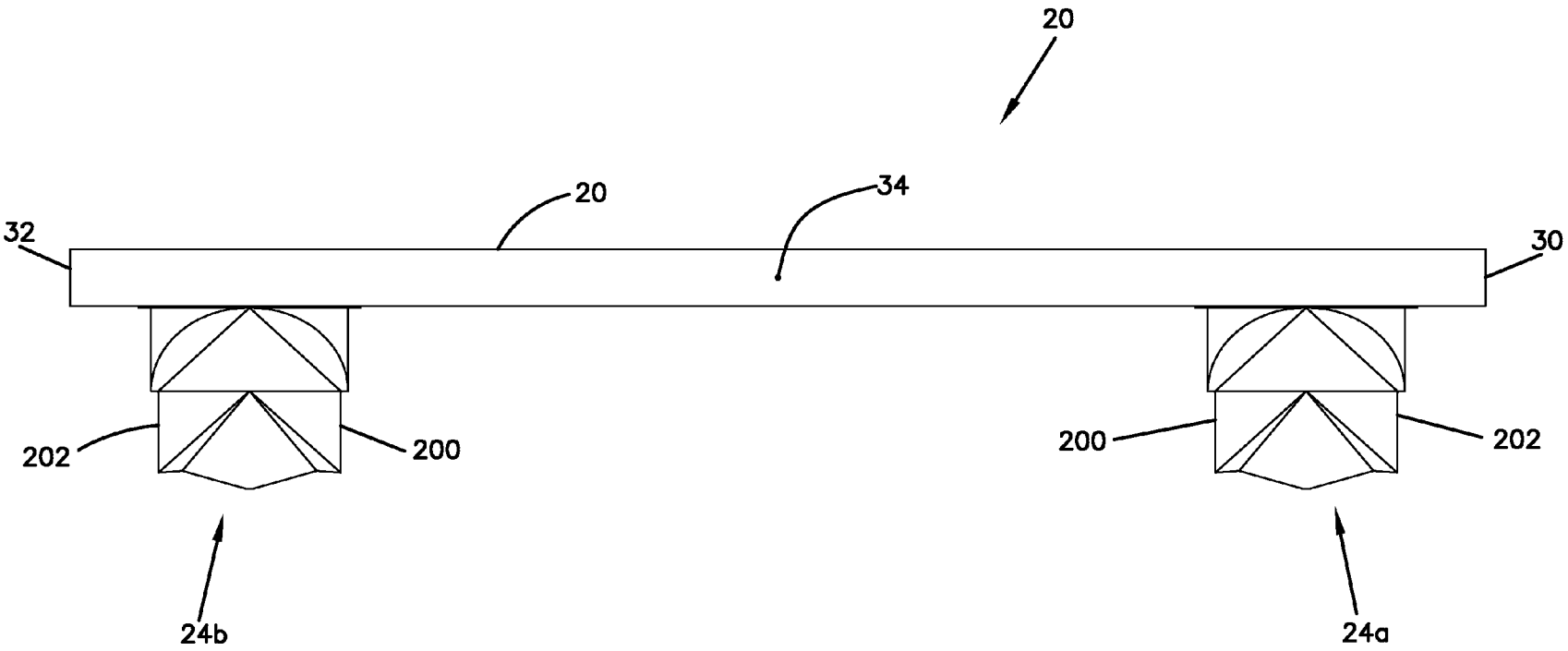
FIG. 18 is a front view of the pontoon boat of FIG. 1.

Referring to FIGS. 1 and 18, the pontoon boat 20 includes two of the sponsons 24. The sponsons 24 are parallel to one another and are positioned on opposite sides of the longitudinal axis 34. One of the sponsons 24 extends along the port side 30 of the pontoon boat 20 while the other sponson 24 extends along the starboard side 32 of the pontoon boat 20. As shown at FIG. 1, sponsons 24 extend along the length of the pontoon boat 20 generally from the stern 28 to the bow 26 and are parallel to the longitudinal axis 34.

In certain embodiments, the sponsons 24 can have a metal construction. For example, in certain embodiments, the sponsons 24 can be constructed of a metal material such as aluminum. In certain embodiments, the sponsons can be manufactured of a plate/sheet metal material such as aluminum plate. In certain embodiments, the material can be 0.090 gage aluminum sheet metal. In other embodiments, different materials having different thicknesses can be used.

It will be appreciated that the sponsons 24 of the two-sponson pontoon boat 20 shown in FIG. 1 are preferably identical. FIGS. 2-5 show one of the sponsons 24. The sponson 24 includes a sponson top 40 and a sponson keel 42. The sponson 24 also includes left and right sides 44, 46 positioned opposite sides of the keel 42. The left and rights sides 44, 46 each extend from the top 40 to the keel 42. The left side 44 includes a left chine 48 and a left dead rise surface 50 that extends from the left chine 48 to the keel 42. The right side 46 includes a right chine 52 and a right dead rise surface 54 that extends from the right chine 52 to the keel 42. In certain embodiments, the left and right dead rise surfaces 50, 54 can have a dead rise angle $\Theta$ greater than 12 degrees, or in the range of 12-24 degrees. In certain embodiments, the left and right chines 48, 52 are angled downwardly (i.e., the chines are turned down). For example, in certain embodiments, the left and right chines 48, 52 are angled downwardly at angles $\alpha$ in the range of 3-5 degrees. The left and right sides 44, 46 can respectively include left and right splash guards 74, 76 positioned between the left and right chines 48, 52 and the top 40. The sponson 24 also preferably includes an integrated keel reinforcing stringer 56 (see FIGS. 3, 4 and 5) that reinforces the keel 42 along the length of the sponson 24.

Figure 2:
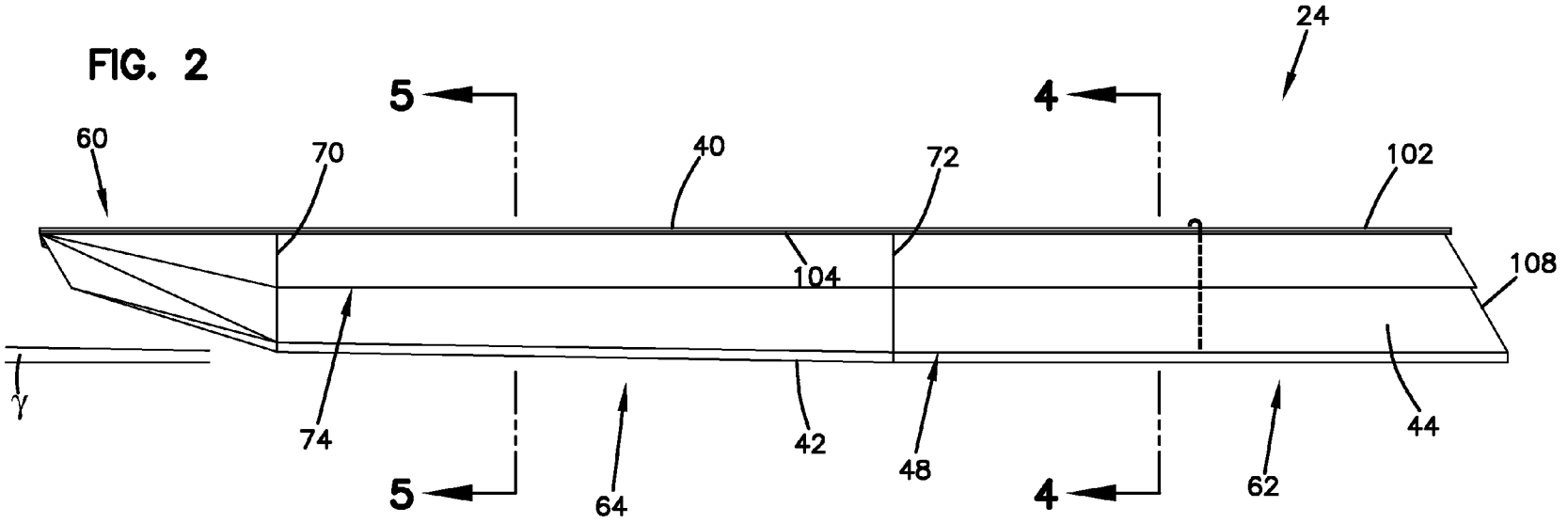
FIG. 2 is a side view of one of the sponsons of the pontoon boat of FIG. 1.
Figure 3:
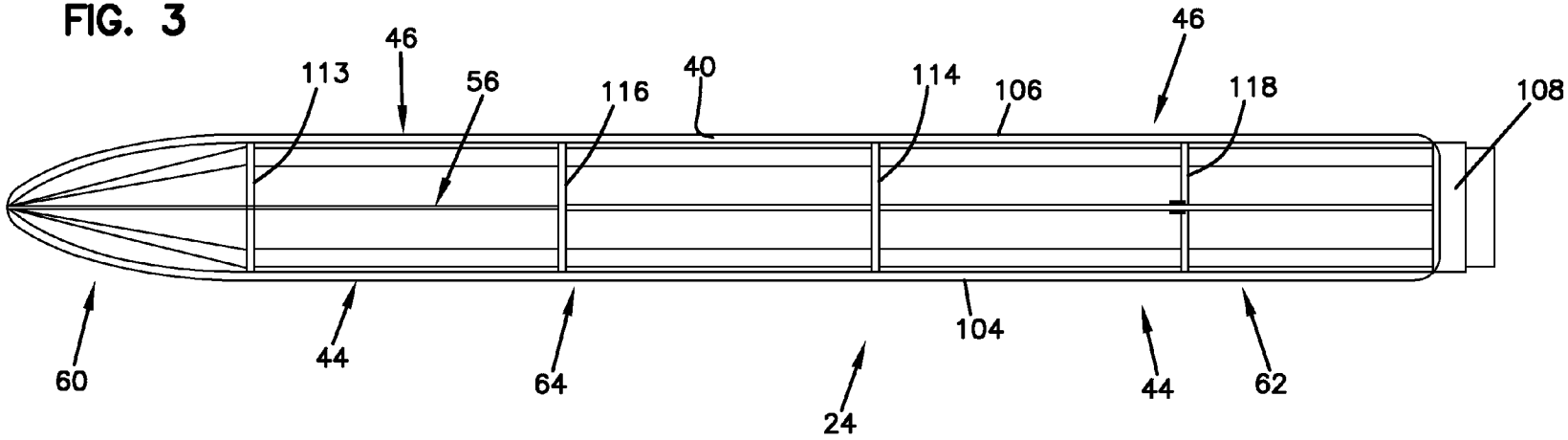
FIG. 3 is a top view of the sponson of FIG. 2 with a top plate structure of the sponson removed.

Referring to FIGS. 2 and 3, the sponson 24 includes a front nose section 60, an aft section 62 and an intermediate section 64. The intermediate section 64 includes a front end 66 and a rear end 68. The front nose section 60 is secured (e.g., welded) to the front end 66 of the intermediate section 64 at a first seam 70 (i.e., a first joint). The aft section 62 is secured (e.g., welded) to the rear end 6 of the intermediate section 64 at a second seam 72 (i.e., a second joint). It will be appreciated that sponsons in accordance with the principles of the present disclosure can be constructed at different lengths. Depending upon the size of the pontoon boat, in certain embodiments, sponsons can range in size from 18 feet to 26 feet. The sectioned design of the sponson 24 promotes manufacturing efficiency by allowing sponsons of different lengths to be manufactured using common/shared parts. For example, the front nose section 60 and the aft section 62 can be standard parts, and the intermediate section 64 can be manufactured having different lengths. Therefore, the overall length of the sponson can be determined by selecting the intermediate section 64 of the appropriate length, and then combining the selected intermediate section 64 with the aft section 62 and the front nose section 60.

In certain embodiments, an outer keel piece 400 (see FIG. 4) in the form of a metal strip (e.g., an aluminum extrusion) can be secured (welded such as spot welded) in place at the outside of the sponson 24 and can be configured to extend along the length of the keel 42 and to cover an interface between the left and right sides 44, 46. In certain embodiments, the bottom of the sponson 24 is sealed by a weld between the left and right sides of the sponson 24 that extends continuously along the length of the keel 42 and that is covered by the outer keel piece 400. While the keel piece 400 of the sponson 24 is only shown at FIG. 4, it will be appreciated that the keel piece 400 preferably extends the entire length of the keel 42 along the front, intermediate and aft sections of the sponson 24.

Referring to FIGS. 6-9, the front nose section 60 includes a front left plate 78 that defines a forward portion **44*f* of the left side 44 of the sponson 24. The front nose section 60 also includes a front right plate 80 that defines a forward portion 46*f* of the right side 46 of the sponson 24. The front left plate 78 is shaped to unitarily define a forward section 48*f* of the left chine 48 (i.e., the forward section 48*f* of the chine 48 is unitary with the front left plate 78). The front left plate 78 also defines a forward portion 50***f* of the left dead rise surface 50. The front right plate 80 is shaped to unitarily define a forward section 52*f* of the right chine 52. The front right plate 80 also defines a forward portion 54*f* of the right dead rise surface 54. The front left and right plates 78, 80 respectively include unitary front left and right keel flanges 82, 84 that extend upwardly from the keel 42. The front left and right keel flanges 82, 84 are secured (e.g., welded) together and cooperate to define a forward portion 56*f* of the keel reinforcing stringer 56. The front left and right plates 78, 80 are also shaped to respectively unitarily define forward sections 74*f*, 76*f* of the left and right splashguards 74, 76.

Figures 4, 5:
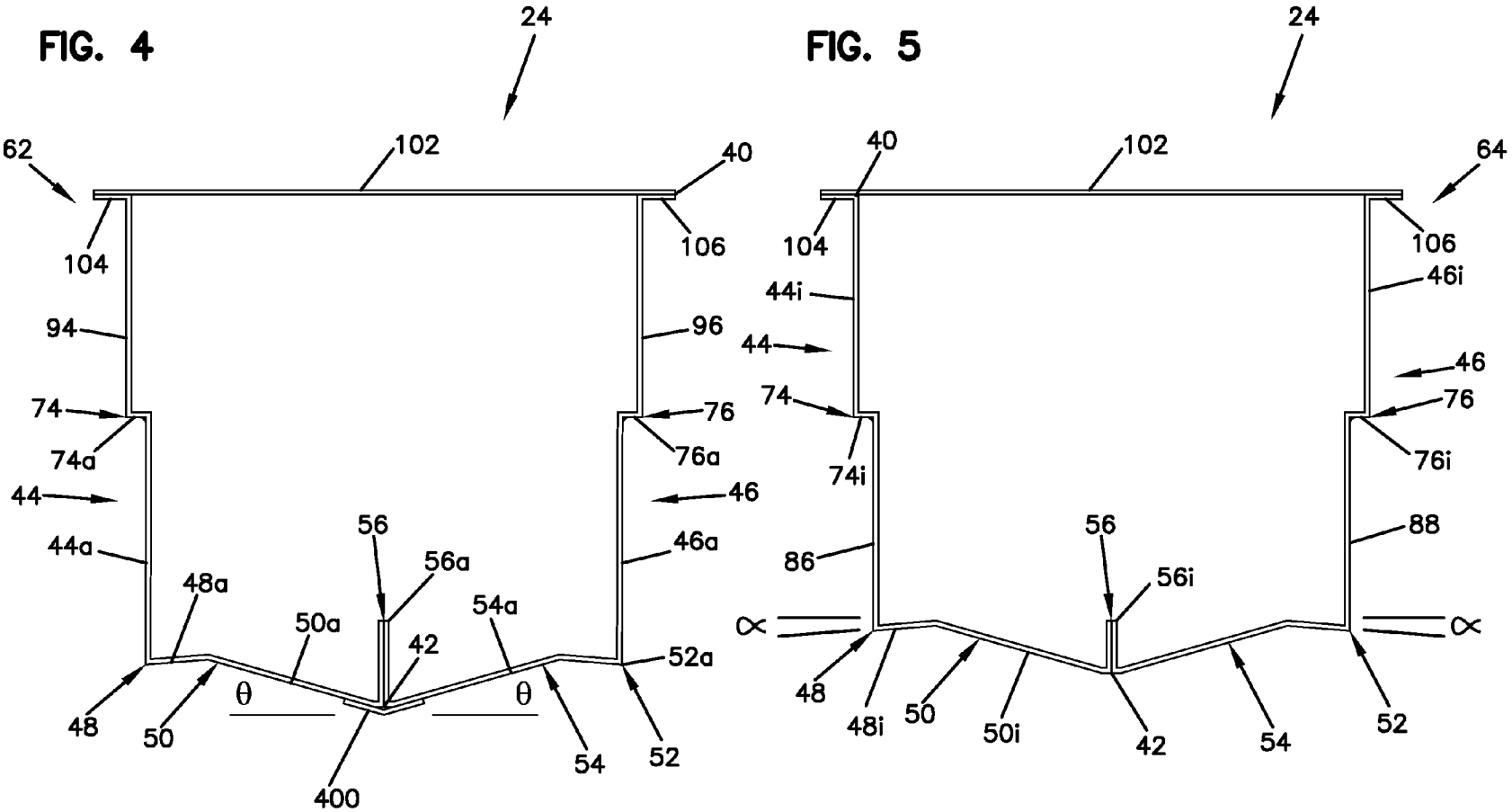
FIG. 4 is a cross sectional view taken along section line 4-4 of FIG. 2.
FIG. 5 is a cross sectional view taken along section line 5-5 of FIG. 2.

Referring to FIGS. 2, 3 and 5, the intermediate section 64 of sponson 24 includes intermediate left and right plates 86, 88 that respectively define intermediate portions 44*i* 46*i* of the left and right sides 44, 46 of the sponson 24. The intermediate left and right plates 46, 88 are shaped to respectively unitarily define intermediate sections 48*i*, 52*i* of the left and right chines 48, 52 of the sponson 24. The intermediate left and right plates 86, 88 also respectively define intermediate portions 50*i*, 54*i* of the left and right dead rise surfaces 50, 54. Additionally, the intermediate left and right plates 86, 88 are shaped to respectively unitarily define intermediate sections 74*i*, 76*i* of the left and right splash guards 74, 76 of the sponson 24. The intermediate left and right plates 86, 88 respectively include unitary intermediate left and right keel flanges 90, 92 that extend upwardly from the keel 42. The intermediate left and right keel flanges 90, 92 are secured, (e.g., welded) together and cooperate to define an intermediate portion 56*i* of the keel reinforcing stringer 56.

Figure 6:
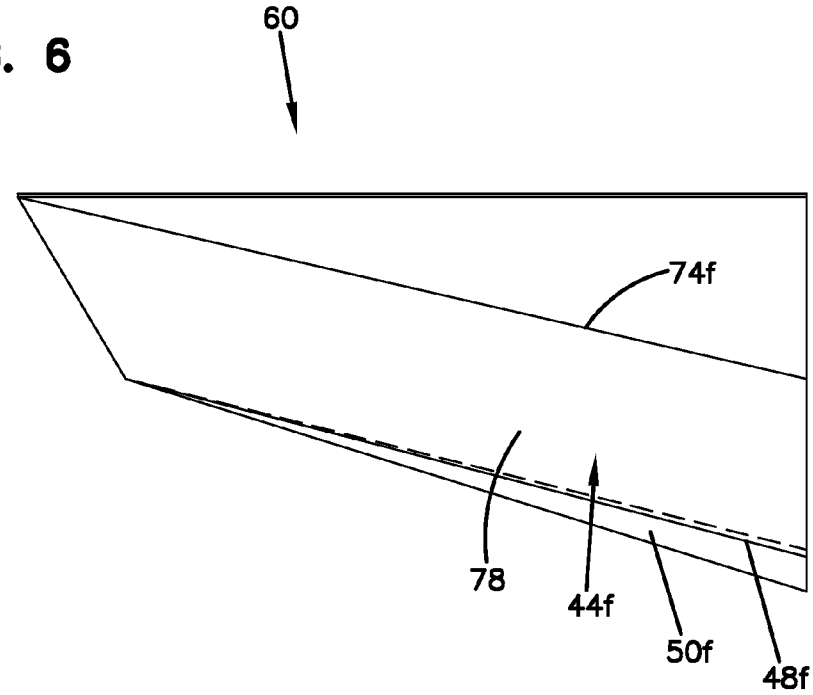
FIG. 6 is a sponson front nose portion of the sponson of FIG. 2.
Figure 7:
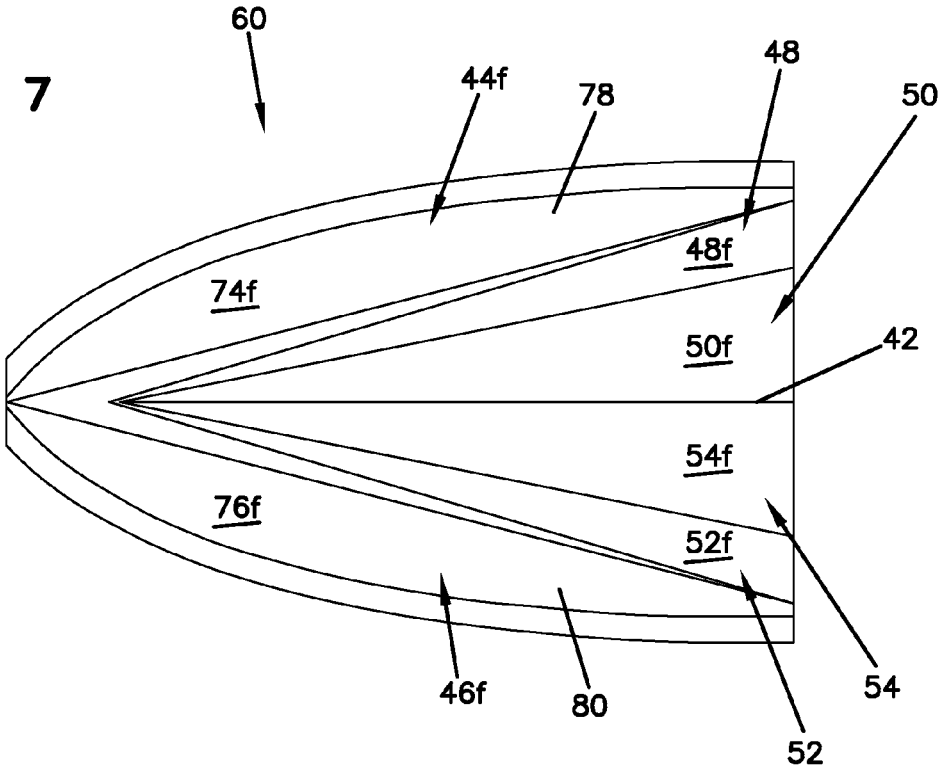
FIG. 7 is a bottom view of the sponson front nose portion of FIG. 6.
Figure 8:
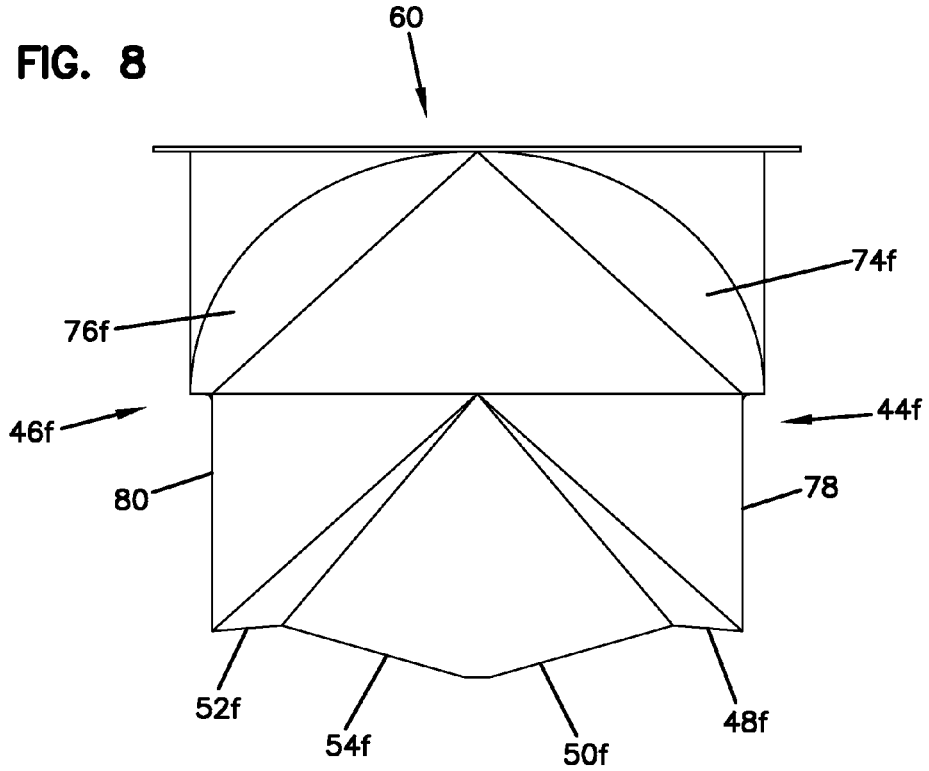
FIG. 8 is a front view of the sponson front nose portion of FIG. 6.
Figure 9:
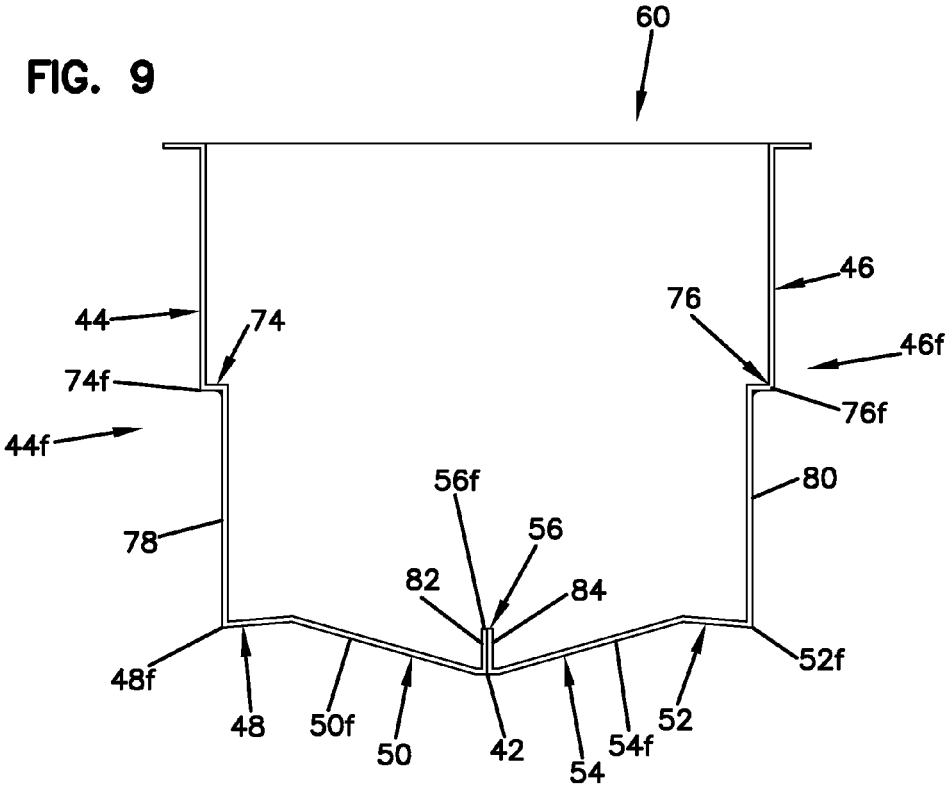
FIG. 9 is a rear view of the sponson front nose portion of FIG. 6.

In the depicted embodiment, the keel reinforcing stringer 56 extends to a height that is higher than corresponding heights of the left and right chines 48, 52 (e.g., see FIGS. 5 and 6). In other words, at a corresponding position along the length of the sponson 24, the keel reinforcing stringer 56 preferably has an upper end that is higher than the heights of the left and right chines 48, 52 the same location along the length of the sponson.

Referring to FIGS. 2-4, the aft section 62 of the sponson 24 includes aft left and right plates 94, 96 that respectively define aft portions 44*a* 46*a* of the left and right sides 44, 46 of the sponson 24. The aft left and right plates 94, 96 are shaped to respectively unitarily define aft sections 48*a*, 52*a* of the left and right chines 48, 52 of the sponson 24. The aft left and right plates 94, 96 also respectively define aft portions 50*a*, 54*a* of the left and right dead rise surfaces 50, 54 of the sponson 24. Additionally, the aft left and right plates 94, 96 respectively unitarily define aft portions 74*a*, 76*a* of the left and right splash guards 74, 76 of the sponson 24. The aft left and right plates 94, 96 respectively include unitary aft left and right keel flanges 98, 100 that extend upwardly from the keel 42 of the sponson 24. The aft left and right keel flanges 98, 100 are secured (e.g., welded) together and cooperate to define an aft portion 56*f* of the keel reinforcing stringer 56.

Referring to FIG. 2-5, the sponson top 40 of the sponson 24 can be enclosed (i.e., covered) by a top plate structure 102 including one or more plates. The top plate structure 102 is preferably fastened to left and right top flanges 104, 106 of the sponson 24. A sealant material can be provided between the top plate structure 102 and the left and right flanges 104, 106 to provide a sealed relationship between the parts.

Figure 11:
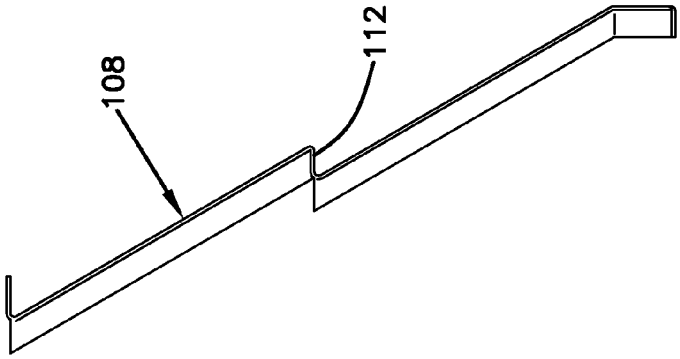
FIG. 11 is a side view of the aft end plate of FIG. 10.
Figure 12:
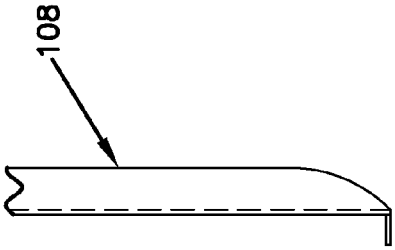
FIG. 12 is a partial top view of the aft end plate of FIG. 10.
Figure 10:
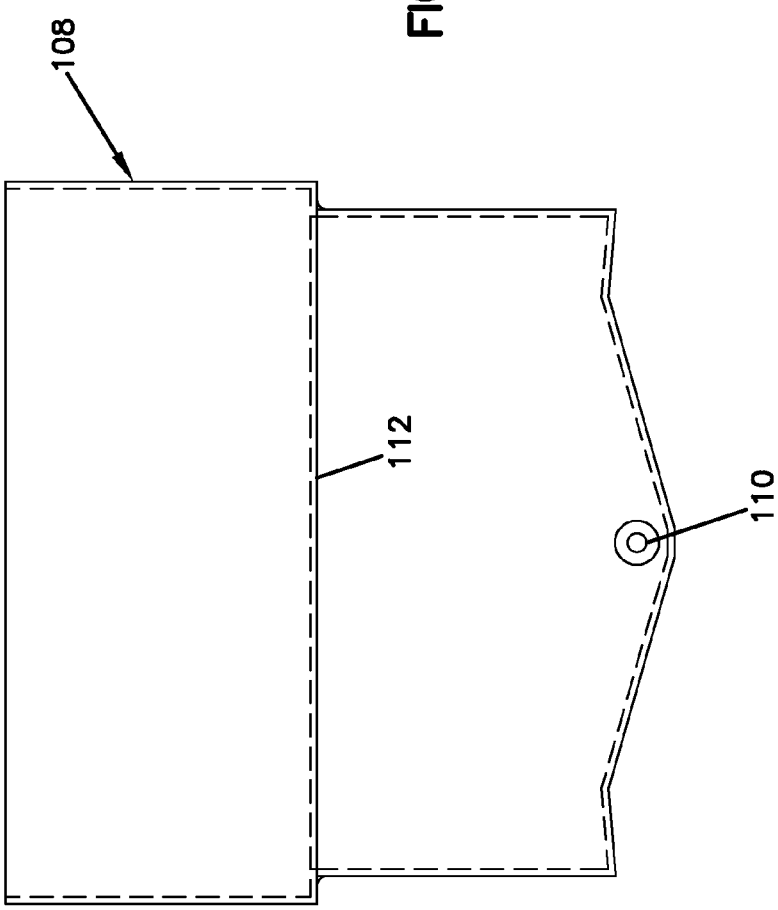
FIG. 10 is a rear view of an aft end plate of the sponson of FIG. 2.

FIGS. 10-12 show an aft end plate 108 that is secured (e.g., welded) to the rear end of the aft section 62 of the sponson 24. The aft end plate 108 has a profile that matches the shape of the profile of the side walls of the sponson 24. A drain opening 110 for draining any moisture that may accumulate within the sponson 24 is provided adjacent a lower end of the aft end plate 108. In use, the drain opening 108 is typically closed by a plug. When the aft end plate 108 is secured to the rear end of the sponson 24, the aft end plate 108 is oriented at an inclined angle such that the aft end plate 108 inclines as the aft end plate 108 extends in a forward direction. The aft end plate 108 defines an intermediate step 112 that aligns with the left and right splash guards 74, 76 provided at the sides of the sponson 24. In certain embodiments, the inclined angling of the aft end plate 108 can assist in allowing the sponsons 24 to have longer running surfaces and to provide more lift for added stern buoyancy, a more level static position and more stability.

In certain embodiments, certain portions of the keel 42 of the sponson 24 can have different angles of attack. For example, an aft portion of the keel 42 (e.g., a portion of the keel 42 that extends along the aft section 62) can have a horizontal angle of attack (i.e., the angle of attack is zero degrees). In certain embodiments, an intermediate section of the keel 42 (e.g., a section of the keel corresponding to the sponson intermediate section 64) can have an inclined angle of attack. In certain embodiments, the inclined angle of attack $\gamma$ can be in the range of 0.5-1.5 degrees. In other embodiments, angle of attack $\gamma$ can be about one degree.

The sponsons 24 are preferably provided with structure for enhancing lateral reinforcement. For example, as shown at FIG. 3, first, second, third, and fourth bulkheads 113, 114, 116 and 118 are secured (e.g., welded) between the left and right sides 44, 46 of the sponson 24. The first bulkhead 113 is secured adjacent the first seam 70. In one embodiment, the first bulkhead 112 is offset about 0.25 inches from the first seam 70. The second bulkhead 114 is positioned adjacent the second seam 72. In one embodiment, the second bulkhead is offset about 0.5 inches from the second seam 72. The third bulkhead 116 is mounted within the intermediate section 64 of the sponson 24 generally at a mid-region of the intermediate section 64. The fourth bulkhead 118 is mounted within the aft section 62 of the sponson 24 generally at a mid-region of the aft section 62. It will be appreciated that prior to mounting the top plate structure 102 on the sponson 24, the sponson top 40 is open. The open configuration of the sponson top 40 facilitates mounting multiple bulkheads at various locations within the length of the sponson 24 to provide for enhanced lateral reinforcement. Once the bulkheads have been mounted in place, the open top 40 can be enclosed by the top plate structure 102.

Referring to FIGS. 13-17, the fourth bulkhead 118 includes an integrated ventilation tube 120. The ventilation tube 120 has an upper end 122 positioned outside and above the sponson 24 and a lower end 124 positioned within the sponson 24 adjacent the keel 42. When no water has leaked inside the sponson 24, the ventilation tube 120 allows air to pass in an out of the sponson as temperatures increase and decrease. This allows the sponson to expand and contract without pressure build-up that can cause cracking. It will be appreciated that other than the ventilation tube 20, the sponson 24 is sealed airtight. In the event an accident occurs in which the sponson is punctured, water will enter the interior of the sponson 24 and block the lower end 124 of the ventilation tube 120. As soon as the lower end 124 of the ventilation tube 120 is blocked, air can no longer exit the sponson 24. Thus, trapped and pressurized air within the sponson 24 prevents the sponson from filling with water. In this way, the pontoon boat 20 can be safely driven to shore even with a punctured sponson.

Figure 13:
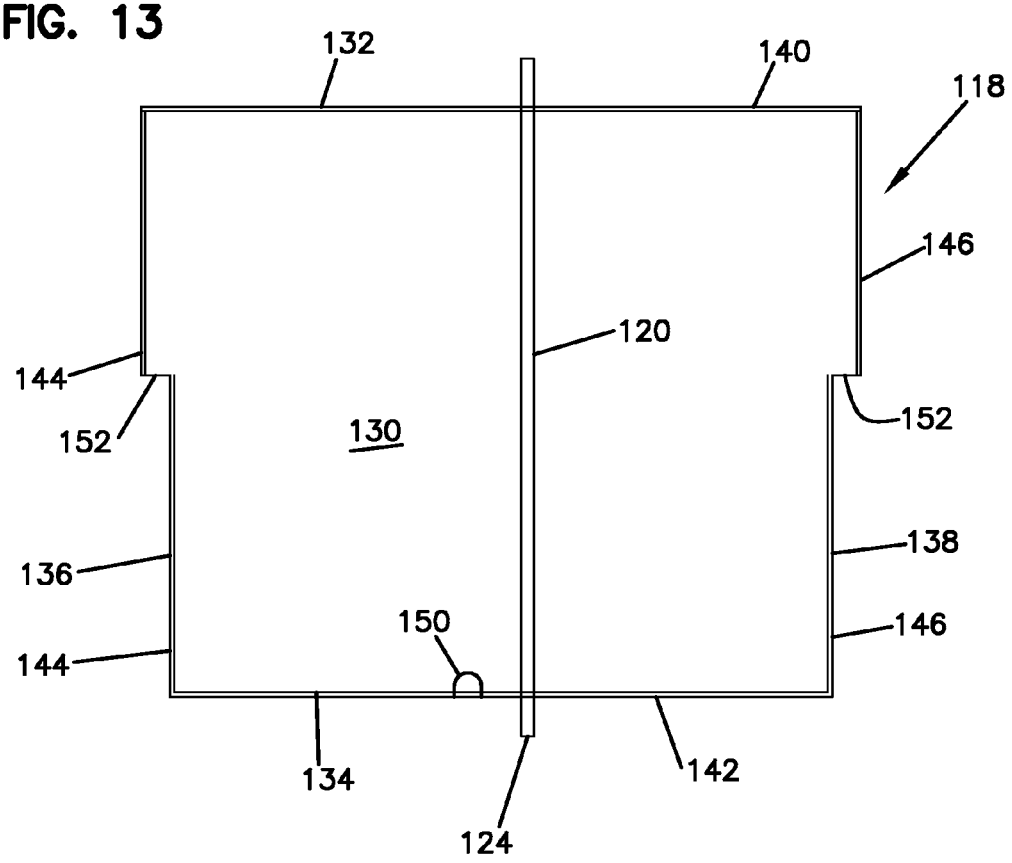
FIG. 13 is a rear view of a bulkhead of the sponson of FIG. 2.
Figure 14:
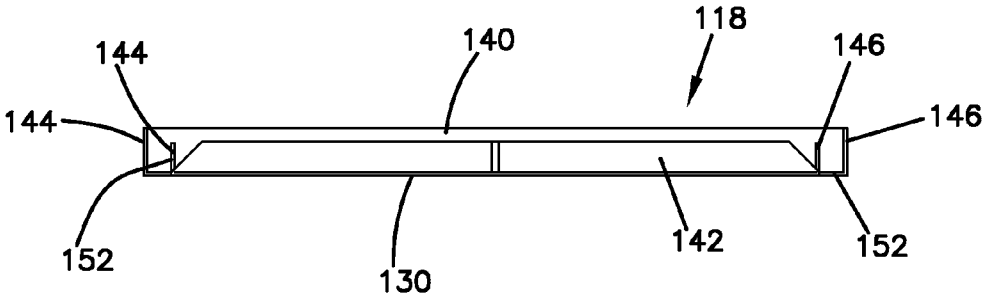
FIG. 14 is a bottom view of the bulkhead of FIG. 13.
Figure 15:
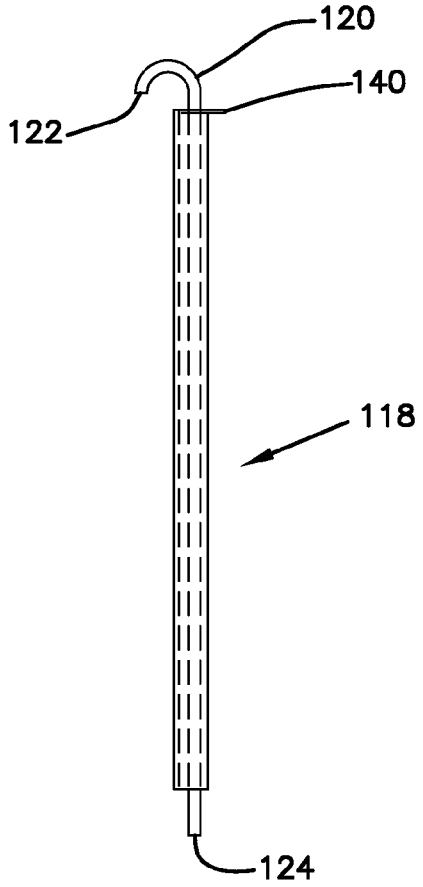
FIG. 15 is an enlarged view of a portion of the bulkhead of FIG. 13.
Figure 16:
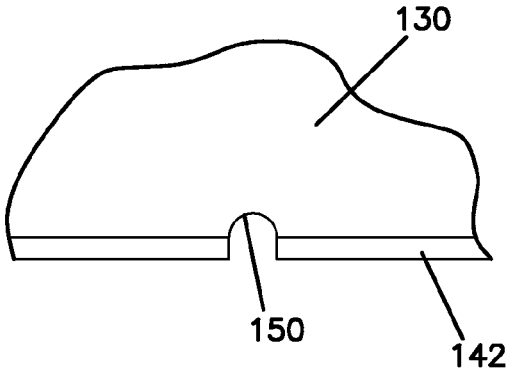
FIG. 16 is a side view of the bulkhead of FIG. 13.
Figure 17:
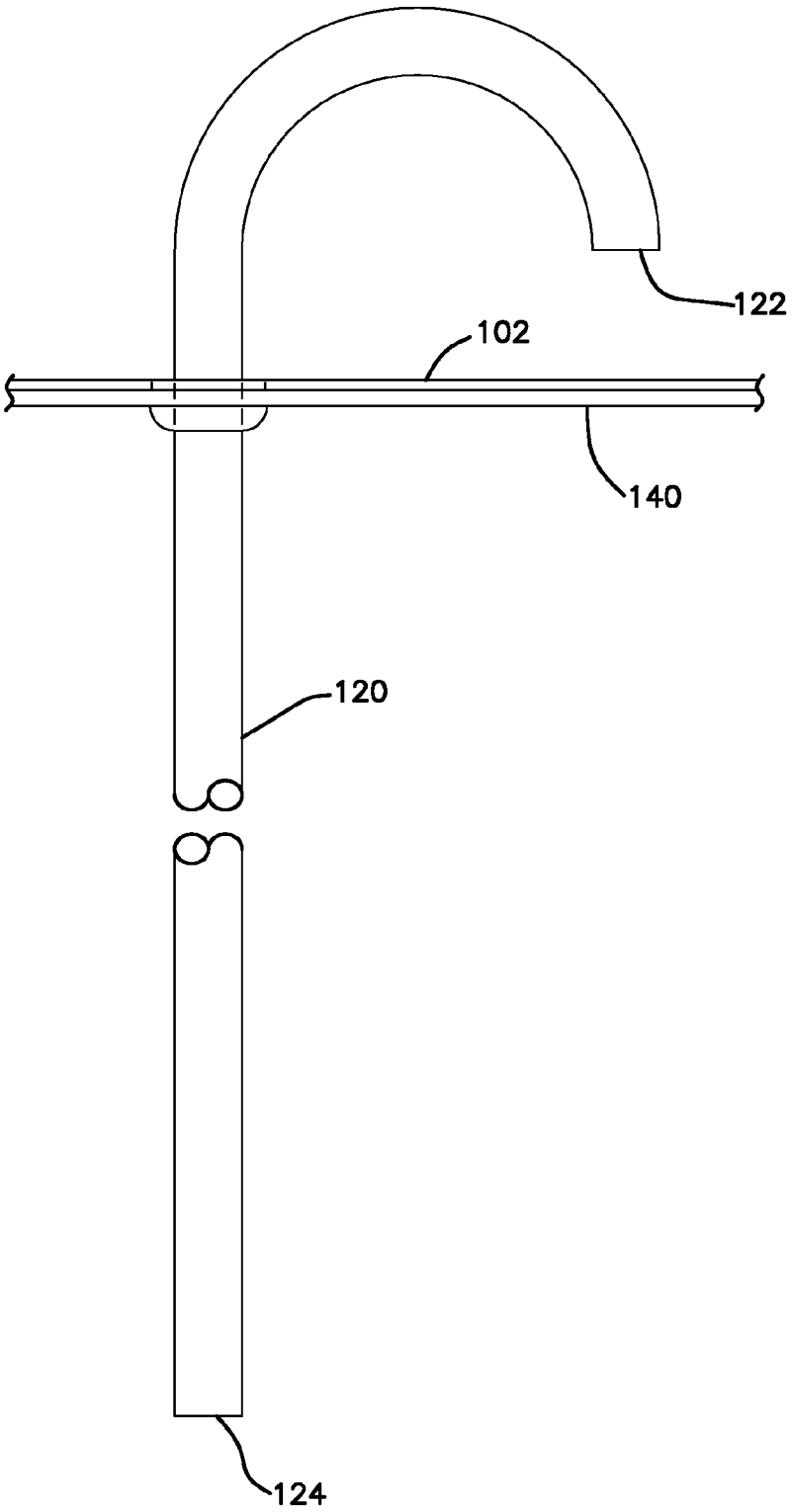
FIG. 17 is an enlarged view of a portion of FIG. 16.

Referring back to FIGS. 13-17, the fourth bulkhead 118 includes a main bulkhead body 130 having an upper end 132, a lower end 134, a left side 136 and a right side 138. The bulkhead 118 also includes a top flange 140 at the upper end 132, a bottom flange 142 at the lower end 134, a left side flange 144 at the left side 136 and a right side flange 146 at the right side 138. The lower end 134 and the bottom flange 142 extend across the width of the sponson 24 between the left and right chines 48, 52. The lower end 134 of the main bulkhead body 130 defines a notch 150 in which the keel reinforcing stringer 56 is received. The bulkhead 118 can be secured (e.g., welded) to the keel reinforcing stringer 56 at the notch 150. Additionally, the left side flange 146 can be secured (e.g., welded) to the sponson left side 44 and the right side flange 48 can be secured (e.g., welded) to the sponson right side 46. The ventilation tube 120 is preferably secured to the bulkhead 118. For example, the ventilation tube 120 can pass through openings defined by the top and bottom flanges 140, 142 and can be secured to the flanges 140, 142 via techniques such as welding. Referring to FIG. 13, the left and right sides 136, 138 define notches 152 that complement the left and right splash guards 74, 76 when the bulkhead 118 is mounted within the sponson 24. It will be appreciated that the other bulkheads 113, 114 and 116 can have the same configuration as the bulkhead 118, but are not shown including ventilation tubes.

Referring to FIG. 18, the sponsons 24 of the pontoon boat 20 of FIG. 1 include a port sponson 24*a* and a starboard sponson 24*b*. The port and starboard sponsons 24*a*, 24*b* are positioned on opposite sides of the longitudinal axis 34 of the pontoon boat 20. The sponsons 24*a*, 24*b* include inboard sides 200 having inboard chines, inboard splash guards and inboard deadrise surfaces. The sponsons 24*a*, 24*b* also include outboard sides 202 having outboard chines, outboard splash guards and outboard deadrise surfaces.

As noted above, in some embodiments more than two sponsons are used. For example, three identical sponsons 24 could be employed. Alternatively, different configurations of sponsons 24 may be used. In one embodiment, a sponson 24 such as that illustrated in FIGS. 2-9 is positioned to extend along the longitudinal axis 34 of the pontoon boat 20, while different sponsons are positioned to extend along the port and starboard sides 30, 32 of the pontoon boat 20.

Figure 19:
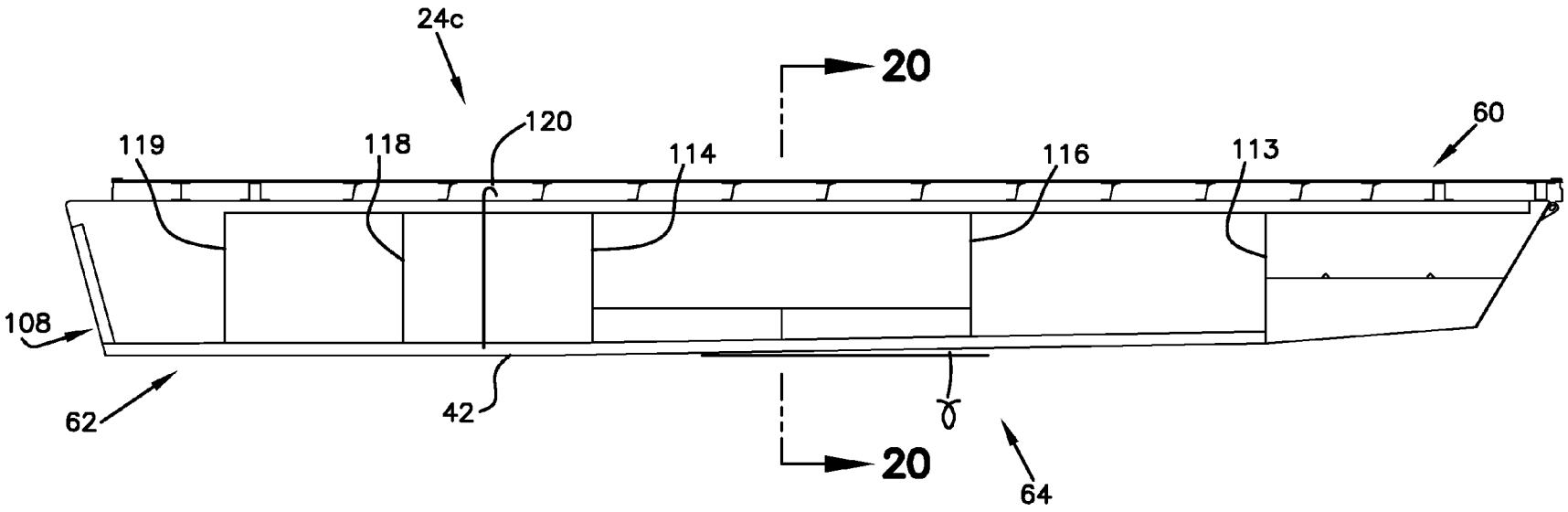
FIG. 19 is a side cross section view taken along line 19-19 of FIG. 20, illustrating portions of an alternative sponson configuration.
Figure 20:
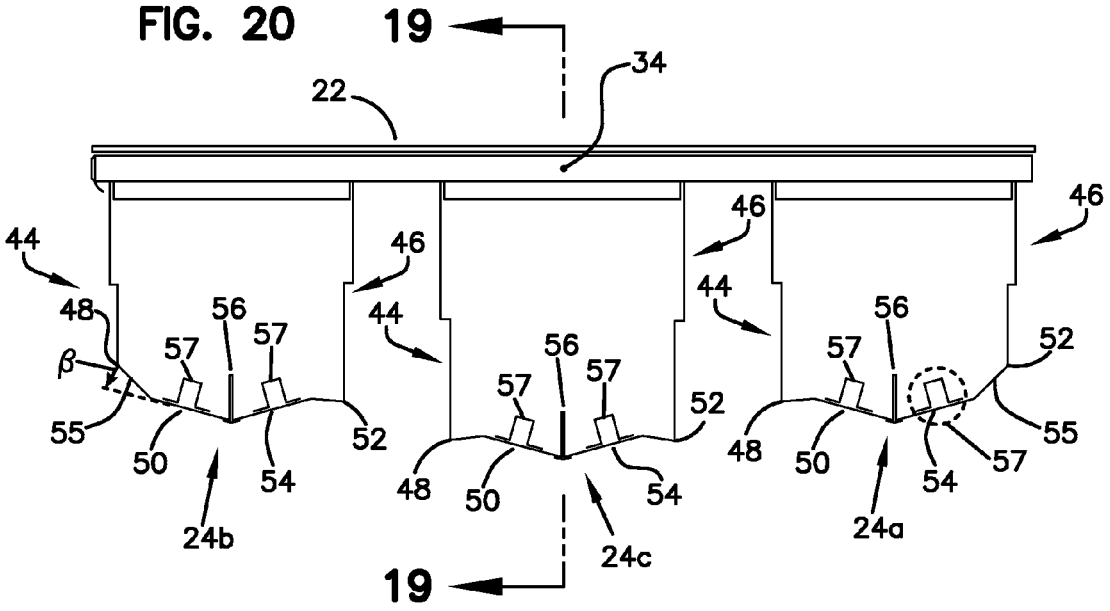
FIG. 20 is a cross section view taken along line 20-20 of FIG. 19, illustrating an embodiment having three sponsons.
Figure 21:
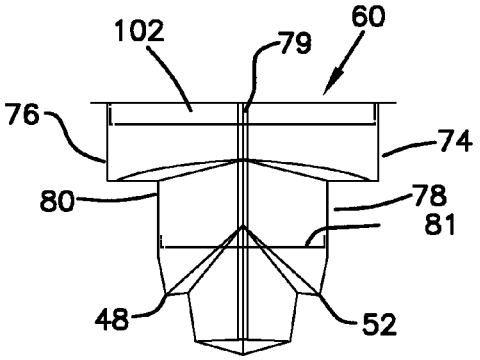
FIG. 21 is a front view of the front nose portion of the center sponson shown in FIG. 20.

FIGS. 19-21 illustrate aspects of an embodiment in which three sponsons are employed. Referring to FIG. 20, a center sponson 24*c* is positioned under the center of the deck 22 so as to extend along the longitudinal axis 32. Port and starboard sponsons 24*a*, 24*b* are situated on either side of the center sponson 24*c* and extend parallel thereto. As shown in the example illustrated in FIG. 20, the center sponson 24*c* has a cross section essentially as illustrated in FIGS. 4 and 5.

The port and starboard sponsons 24*a*, 24*b* shown in FIG. 20 are similar to the center sponson 24*c*, though the illustrated examples each include an outside chamfer 55. Thus, the port and starboard sponsons 24*a*, 24*b* shown in FIG. 20 are not symmetrical about a center longitudinal axis of the sponson as the center sponson 24*c*, but are mirror images of one another. Thus, the port sponson 24*a* has an outside chamfer 55 extending between its right chine 52 and right dead rise surface 54. The starboard sponson 24*b* has an outside chamfer 55 extending between its left chine 48 and left dead rise surface 50. In some examples, the outside chamfers 55 each define an angle β between 25 and 28 degrees, and in the embodiment illustrated in FIG. 20, the angle β is about 27 degrees.

Figure 20A:
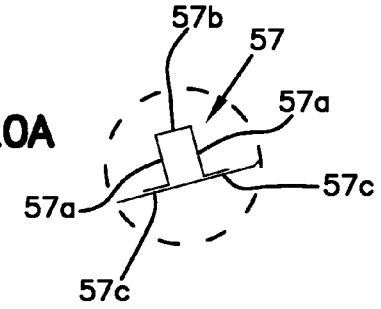
FIG. 20A is a detailed view of the hull stringer shown in FIG. 20.

As with the sponson 24 illustrated in FIGS. 4 and 5, the sponsons 24*a*, 24*b*, 24*c* each include the integrated keel reinforcing stringer 56 that reinforces the keel 42 along the length of the sponsons 24*a*, 24*b*, 24*c*. Additionally, some examples include hull stringers 57 attached to the dead rise surfaces 50, 54 extending along the length of the sponsons 24*a*, 24*b*, 24*c*, parallel to the keel of the sponson. FIG. 20A is a close up view of an example hull stringer 57. The hull stringers 57 may be fabricated, for example, from 0.100 gage aluminum sheet metal. The illustrated example is generally "top hat" shaped, including opposing sides 57*a*, a top surface 57*b* extending between the sides 57*a*, and mounting feet 57*c* extending outwardly from the sides 57*a*. The mounting feet 57*c* are attached (e.g. welded) to the inside portions of the dead rise surfaces 50, 54.

In some examples, the sponsons 24*a*, 24*b*, 24*c* illustrated in FIG. 20 each have a lateral width of about 30 inches. The overall width of the deck in the illustrated example is about 102 inches. Thus, the top surfaces 40 of the sponsons 24*a*, 24*b*, 24*c* together directly support nearly 90% of the width of the deck 22. Accordingly, the example shown in FIG. 20 does not require additional bracing to support the deck 22.

As further shown in FIG. 20, the center sponson 24*c* defines a vertical distance from the keel 42 to the deck 22 that that is greater than the corresponding vertical distances of the port and starboard sponsons 24*a*, 24*b*. For example, in some embodiments the port and starboard sponsons 24*a*, 24*b* extend 26 inches from the top surface 40 to the keel 42, and the center sponson 24*c* extends 30 inches from its top surface 40 to its keel 42. The center sponson 24*c* extends below the port and starboard sponsons 24*a*, 24*b* 4 inches as viewed in FIG. 20, and thus extends farther into the water than the port and starboard sponsons 24*a*, 24*b*. This configuration of the three sponsons 24*a*, 24*b*, 24*c* generally provides an overall V-shaped hull.

As noted above, in some embodiments certain portions of the keel 42 of the sponson 24 can have different angles of attack. Referring to FIG. 19, the aft portions 62 of each of the sponsons 24*a*, 24*b*, 24*c* extend from the respective end plates 108 about one half of the distance to the end of the nose section 60. For example, in some embodiments the sponsons 24*a*, 24*b*, 24*c* are about 25 feet long, depending on the particular pontoon boat configuration, and the aft portion 62 of the sponsons 24 extend 144 inches from the end plate 180 towards the nose section 60. In the illustrated example, the aft portion 62 of the keel 42 has a horizontal angle of attack (i.e., the angle of attack is zero degrees). The section of the keel 42 corresponding to the sponson intermediate section 64 has an inclined angle of attack γ as illustrated in FIG. 19. In certain embodiments, the inclined angle of attack γ can be in the range of 0.5-1.5 degrees. In other embodiments, angle of attack γ can be about one degree. The generally V-shaped hull bottom formed by the configuration of the three sponsons 24*a*, 24*b*, 24*c* shown in FIG. 21, together with the inclined angle of attack of the intermediate section 64 of the keel 42 helps the hull get on plane more quickly and reduce wave impact.

As illustrated in FIG. 19, the sponsons 24*a*, 24*b*, 24*c* each include five internal cross bulkheads 113, 114, 116, 117 and 118 that are secured (e.g., welded) between the left and right sides 44, 46 of the sponson 24. Among other things, the provision of multiple bulkheads in each of the sponsons increases strength of the sponsons and results in and less racking. The sponsons 24*a*, 24*b*, 24*c* shown in FIG. 21 each include venting tubes 120 similar to those disclosed and described in conjunction with FIGS. 13-17.

FIG. 21 illustrates an example of the nose section 60 of the sponsons 24*a*, 24*b*, 24*c* shown in FIG. 20. The example nose section 60 shown in FIG. 21 is similar to that described in conjunction with FIGS. 6-9. The front nose section 60 shown in FIG. 21 includes a front left plate 78 and a front right plate 80, and further respectively includes left and right splash guards 74, 76 positioned between the left and right chines 48, 52 and the top 40. In the version shown in FIG. 21, the splash guards 76, 76 are angled so as to extend generally parallel to the keel 42 of the nose section 60. For example, the nose section 60 illustrated in FIG. 21 defines an angle of attack between 2-4 degrees, and the splash guard thus also is situated to also be angled about 2-4 degrees relative to horizontal. The nose section 60 illustrated in FIG. 21 further includes a V-entry extrusion 79 attached to the junction of the front right and left plates 78, 80. A horizontal baffle 81 is attached inside the nose section 60.

In alternative embodiments, the pontoon boat 20 includes only two sponsons as illustrated in FIG. 18, though employing the port and starboard sponsons 24*a*, 24*b* as shown in FIG. 20.

The embodiments disclosed herein are intended to illustrate without limitation the utility and scope of the present disclosure. Those skilled in the art will readily recognize various modifications and changes that may be made to the embodiments without departing from the true spirit and scope of the disclosure.

What is claimed is:

1. A sponson having a sponson top and a sponson keel, the sponson comprising:

a sponson left side that extends from the sponson top to the sponson keel, the sponson left side including a sponson left chine and a sponson left deadrise surface that extends from the sponson left chine to the sponson keel;

a sponson right side that extends from the sponson top to the sponson keel, the sponson right side including a sponson right chine and a sponson right deadrise surface that extends from the sponson right chine to the sponson keel; and a left keel flange that is integral with the sponson left side and a right keel flange that is integral with the sponson right side, the left and right keel flanges extending upwardly from the sponson keel and being secured together to form a keel reinforcing stringer that extends along the sponson keel.

2. The sponson of claim 1, wherein the sponson includes a top plate structure that encloses the sponson tops.

3. The sponson of claim 2, wherein the top plate structure is fastened to left and right top sponson flanges of the sponson, and wherein a sealed relationship exists between the left and right top sponson flanges and the top plate structure.

4. The sponson of claim 1, wherein the sponson left chine and the sponson right chine are angled downwardly.

5. The sponson of claim 1, wherein the sponson left chine and the sponson right chine are angled downwardly at angles in the range of 3-5 degrees.

6. The sponson of claim 1, wherein the left and right deadrise surfaces have deadrise angles in the range of 12-24 degrees.

7. The sponson of claim 1, wherein the left and right deadrise surfaces have deadrise angles greater than 12 degrees.

8. The sponson of claim 1, wherein the sponson left side includes a sponson left splash guard positioned between the sponson left chine and the sponson top, and wherein the sponson right side includes a sponson right splash guard positioned between the sponson right chine and the sponson top.

9. The sponson of claim 1, further comprising bulkheads secured between the sponson left side and the sponson right side, and wherein a vent tube is integrated with the bulkhead.

10. The sponson of claim 1, further comprising bulkheads secured between the sponson left side and the sponson right side, the bulkheads including left flanges welded to the sponson left sides and right flanges welded to the sponson right sides.

11. The sponson of claim 1, wherein the keel reinforcing stringer extends higher than the sponson left and right chines.

12. The sponson of claim 11, further comprising bulkheads secured between the sponson left side and the sponson right side, the bulkheads including main plate bodies, the bulkheads also including upper bulkhead flanges at upper ends of the bulkheads, lower bulkhead flanges at lower ends of the bulkheads, left bulkhead flanges at left sides of the bulkheads and right bulkhead flanges at right sides of the bulkheads, the left bulkhead flanges being welded to the sponson left sides, the right bulkhead flanges being welded to the sponson right sides, the lower ends of the bulkheads extending between the sponson left and right chines, the lower ends of the bulkheads defining lower bulkhead notches in which the keel reinforcing stringers are received, and the lower ends of the bulkheads being welded to the keel reinforcing stringers at the lower bulkhead notches.

13. The sponson of claim 12, wherein the sponson left side includes a sponson left splash guard positioned between the sponson left chine and the sponson top, wherein the sponson right side includes a sponson right splash guard positioned between the sponson right chine and the sponson top, wherein the left sides of the bulkheads include left bulkhead notches that complement the sponson left splash guard, and wherein the right sides of the bulkheads include right bulkhead notches that complement the sponson right splash guard.

14. The sponson of claim 1, wherein the sponson keel has a horizontal angle of attack along an aft section and an inclined angle of attack along an intermediate section.

15. The sponson of claim 14, wherein the inclined angle of attack is in the range of 0.5 to 1.5 degrees relative to horizontal.

16. The sponson of claim 14, wherein the inclined angle of attack is about 1 degree relative to horizontal.

17. The sponson of claim 1, further comprising an aft end plate mounted at an aft end of the sponson, the aft end plate being oriented at an inclined angle such that the aft end plate inclines as the aft end plate extends in a forward direction.

18. The sponson of claim 1, further comprising a chamfer extending between the sponson right chine and the sponson right deadrise surface.

19. The sponson of claim 1, further comprising a chamfer extending between the sponson left chine and the sponson left deadrise surface.

20. The sponson of claim 1, further comprising a hull stringer connected to the sponson right deadrise surface and extending parallel to the sponson keel.

21. The sponson of claim 1, further comprising a hull stringer connected to the sponson left deadrise surface and extending parallel to the sponson keel.

22. A sponson comprising:

a sponson top and a sponson keel;

a sponson left side that extends from the sponson top to the sponson keel and a sponson right side that extends from the sponson top to the sponson keel, the sponson left side including a sponson left chine and a sponson left deadrise surface that extend from the sponson left chine to the sponson keel, the sponson right side including a sponson right chine and a sponson right deadrise surface that extends from the sponson right chine to the sponson keel, the left and right deadrise surfaces having deadrise angles, the sponson also including a keel reinforcing stringer that extends along the sponson keel;

a sponson front nose section, a sponson aft section and a sponson intermediate section, the sponson intermediate section including a front end and a rear end, the sponson front nose section being secured to the front end of the sponson intermediate section at a first seam, and the sponson aft section being secured to the rear end of the sponson intermediate section at a second seam;

the sponson front nose section including a front left plate that defines a forward portion of the sponson left side, and a front right plate that defines a forward portion of the sponson right side, the front left plate being shaped to define a forward section of the sponson left chine and a forward portion of the sponson left deadrise surface, the front right plate being shaped to define a forward section of the sponson right chine and a forward portion of the sponson right deadrise surface, the front left plate including a front left keel flange that extends upwardly from the sponson keel, the front right plate including a front right keel flange that extends upwardly from the sponson keel, the front left keel flange and the front right keel flange being secured together and cooperating to define a forward portion of the keel reinforcing stringer;

the sponson intermediate section including an intermediate left plate that defines an intermediate portion of the sponson left side, and an intermediate right plate that defines an intermediate portions of the sponson right side, the intermediate left plate being shaped to define an intermediate section of the sponson left chine and an intermediate portion of the sponson left deadrise surface, the intermediate right plate being shaped to define an intermediate section of the sponson right chine and an intermediate portion of the sponson right deadrise surface, the intermediate left plate including an intermediate left keel flange that extends upwardly from the sponson keel, the intermediate right plate including an intermediate right keel flange that extends upwardly from the sponson keel, the intermediate left keel flange and the intermediate right keel flange being secured together and cooperating to define an intermediate portion of the keel reinforcing stringer; and the sponson aft section including an aft left plate that defines an aft portion of the sponson left side, and an aft right plate that defines an aft portion of the sponson right side, the aft left plate being shaped to define an aft section of the sponson left chine and an aft portion of the sponson left deadrise surface, the aft right plate being shaped to define an aft section of the sponson right chine and an aft portion of the sponson right deadrise surface, the aft left plate including an aft left keel flange that extend upwardly from the sponson keel, the aft right plate including an aft right keel flange that extends upwardly from the sponson keel, the aft left keel flange and the aft right keel flange being secured together and cooperating to define an aft portion of the keel reinforcing stringer.

* * * * *